US005423260A

United States Patent [19]

Goldberg et al.

[11] Patent Number: 5,423,260

[45] Date of Patent: Jun. 13, 1995

[54] DEVICE FOR HEATING A PRINTED WEB FOR A PRINTING PRESS

[75] Inventors: Ira B. Goldberg, Thousand Oaks, Calif.; Ragy Isaac, Bolingbrook, Ill.

[73] Assignee: Rockwell International Corporation, El Segundo, Calif.

[21] Appl. No.: 125,968

[22] Filed: Sep. 22, 1993

[51] Int. Cl.[6] ..... B41F 35/00

[52] U.S. Cl. ..... 101/424.1; 101/487

[58] Field of Search ..... 101/424.1, 487, 488; 219/679, 681, 684, 693, 698, 700, 707, 705

[56] References Cited

U.S. PATENT DOCUMENTS

| | | | |
|---|---|---|---|
| 2,500,752 | 3/1950 | Hanson et al. | 219/693 |
| 3,197,601 | 7/1965 | Wayne et al. | 219/693 |
| 3,263,052 | 7/1966 | Jeppson et al. | 219/700 |
| 3,290,587 | 12/1966 | Chafee | 324/643 |
| 3,418,723 | 12/1968 | Burgess et al. | 34/265 |
| 3,426,439 | 2/1969 | Ryman et al. | 34/259 |
| 3,470,343 | 9/1969 | Bilbrough | 219/693 |
| 3,474,544 | 10/1969 | Holden, Jr. et al. | 219/55 |
| 3,475,827 | 11/1969 | Goerz, Jr. | 34/1 |
| 3,484,179 | 12/1969 | Adams et al. | 8/444 |
| 3,488,858 | 1/1970 | Bilbrough | 34/265 |
| 3,491,457 | 1/1970 | Schreiber et al. | 34/265 |
| 3,507,050 | 4/1970 | Smith et al. | 34/265 |
| 3,589,022 | 6/1971 | Hering, Jr. | 34/1 |
| 3,670,133 | 6/1972 | Admiraal | 219/10.55 |
| 3,672,066 | 6/1972 | Stephansen | 34/1 |
| 3,678,594 | 7/1972 | Goerz, Jr. et al. | 34/1 |
| 3,707,773 | 1/1973 | Wolfberg et al. | 34/1 |
| 3,710,063 | 1/1973 | Aine | 219/10.55 |
| 3,710,064 | 1/1973 | Mathur | 219/10.55 |
| 3,711,674 | 1/1973 | Admiraal | 219/10.55 |
| 3,712,971 | 1/1973 | Admiraal | 219/693 |
| 3,731,036 | 5/1973 | Hallier et al. | 219/695 |
| 3,739,130 | 6/1973 | White | 219/10.55 |
| 3,740,515 | 6/1973 | Vankoughnett | 219/10.55 |
| 3,744,147 | 7/1973 | Pless | 34/1 |
| 3,771,234 | 11/1973 | Forster et al. | 219/698 |
| 3,775,860 | 12/1973 | Barnes et al. | 34/1 |
| 3,851,132 | 11/1974 | VanKoughnett | 219/10.55 |
| 3,854,389 | 1/1975 | Hilton et al. | 99/295 |
| 3,858,329 | 1/1975 | Koide et al. | 34/1 |
| 3,872,603 | 3/1975 | Williams et al. | 34/1 |
| 3,953,703 | 4/1976 | Hurwitt | 219/55 |
| 4,045,638 | 8/1978 | Chiang et al. | 219/701 |
| 4,149,322 | 4/1979 | Minoda et al. | 34/4 |
| 4,188,361 | 12/1979 | Loof | 34/1 |
| 4,234,775 | 11/1980 | Wolfberg et al. | 219/10.55 |
| 4,274,209 | 6/1981 | Kawaguchi | 34/1 |
| 4,365,422 | 12/1982 | Kawaguchi | 34/1 |
| 4,377,039 | 3/1983 | Hager | 34/1 |
| 4,405,850 | 9/1983 | Edgar | 219/10.55 |
| 4,485,564 | 12/1984 | Iverlund et al. | 34/1 |
| 4,738,752 | 4/1988 | Busker et al. | 162/359 |
| 4,795,871 | 1/1989 | Strattan et al. | 219/707 |
| 4,856,201 | 8/1989 | Dokoupil et al. | 34/1 |
| 4,889,965 | 12/1989 | Gervais et al. | 219/10.55 |
| 4,976,820 | 12/1990 | Laapotti | 162/206 |
| 4,991,539 | 2/1991 | Sarda | 219/679 |
| 5,020,237 | 6/1991 | Gross et al. | 219/707 |
| 5,107,602 | 4/1992 | Loof | 34/1 |
| 5,146,058 | 9/1992 | Herfindahl et al. | 219/10.55 |
| 5,175,406 | 12/1992 | Roussy et al. | 219/10.61 |
| 5,220,346 | 6/1993 | Carreira et al. | 346/1.1 |

*Primary Examiner*—Edgar S. Burr
*Assistant Examiner*—Anthony H. Nguyen
*Attorney, Agent, or Firm*—C. B. Patti; H. F. Hamann

[57] ABSTRACT

A device (10) for heating ink on a printed web (12) from a printing press (14) having a tunnel (16) defining a chamber (18) which has an inlet (20) for introducing the web (12) into the chamber (18), and an outlet (22) for removing the web (12) from the chamber (18). The device (10) has a microwave power source (24) for introducing microwave energy in the chamber (18) in order to heat the web (12) and heat set inks on tile web (12).

15 Claims, 2 Drawing Sheets

DEVICE FOR HEATING A PRINTED WEB FOR A PRINTING PRESS

BACKGROUND OF THE INVENTION

The present invention relates to heating devices for a printed web in a printing press.

In the past, printing presses have been utilized to print colored or black inks on opposed sides of a paper web. Such inks usually comprise a vehicle composed of a resin and a solvent, along with a colored pigment and other additives. During offset printing water is added to the ink and paper.

After printing of the web has taken place, it is necessary to remove the water and a large portion of the solvent from the ink in order to change the viscosity of the ink and set the ink containing the pigment. Presently, relatively long tunnels have been utilized in order to heat set the inks utilizing hot air convection in the tunnels which supply the necessary heat transfer to heat set the inks. However, during convection heating an air barrier is formed between the web and heat source, and the barrier significantly slows down the solvent release. However, such air convention heating is relatively inefficient and slow. Heating the web and removing the solvents thus requires excessively long tunnels and unnecessary expenditure of energy in order to heat set the inks. Further, if shorter tunnels for convention heating are utilized to heat the web, then the speed of the press and associated web must be lowered in order to obtain the necessary heating, and thus such air convention heating devices also place limitations on the speed of the web and press. Also, such long tunnels are unduly costly and an excessive amount of air must be circulated in the tunnels in order to obtain the desired drying or heat setting of the inks.

SUMMARY OF THE INVENTION

A principle feature of the present invention is the provision of an improved heating device for the inks on printed webs with ink in a printing press.

The device of the present invention comprises, means defining a chamber having an inlet for introducing the web into the chamber, and an outlet for removing the web from the chamber.

A feature of the present invention is the provision of means for introducing a source of microwaves into the chamber.

Another feature of the invention is that the microwave source heats the web and heat sets the ink on the web.

Yet another feature of the invention is that heating of the web with the microwave source requires significantly less time than prior air convection heating techniques.

Thus, a feature of the invention is that tunnels or chambers utilized to heat set the inks may be significantly shorter that those requited for prior convection heating techniques.

A further feature of the invention is that the microwave heating source does not nearly pose such limitations on the speed of the printed web and the press.

Still another feature is that the microwave source is significantly more efficient for heating the web than the prior air convention heating techniques, and thus conserves energy resulting in substantially less cost to operate the heating devices in the press.

Another feature of the invention is that air may be circulated over the heated web in order to remove solvents from the inks, and substantially less air is required to remove solvents from the web heated by the microwave device than for the prior air convection heating techniques.

Yet another feature of the invention is that the circulation of air in the chamber may be automatically controlled dependent upon conditions in the chamber.

Still another feature of the invention is that the energy of the microwave source may be automatically controlled dependent upon the conditions in the chamber.

A further feature of the invention is that the heated web may be placed at locations of maximum microwave energy in the chamber.

Another feature of the invention is that the web may be located at a distance from a microwave reflecting surface where the maximum energy of the microwaves is located in the chamber.

Yet another feature of the invention is that opposed sides the web may be covered with porous heating layers of a material which absorbs a portion of the microwave energy in order to obtain improved heating of the web, and the air in the vicinity of the web.

Further features will become more fully apparent in the following description of the embodiments of this invention, and from the appended claims.

DESCRIPTION OF THE PREFERRED EMBODIMENTS

Figure 1:
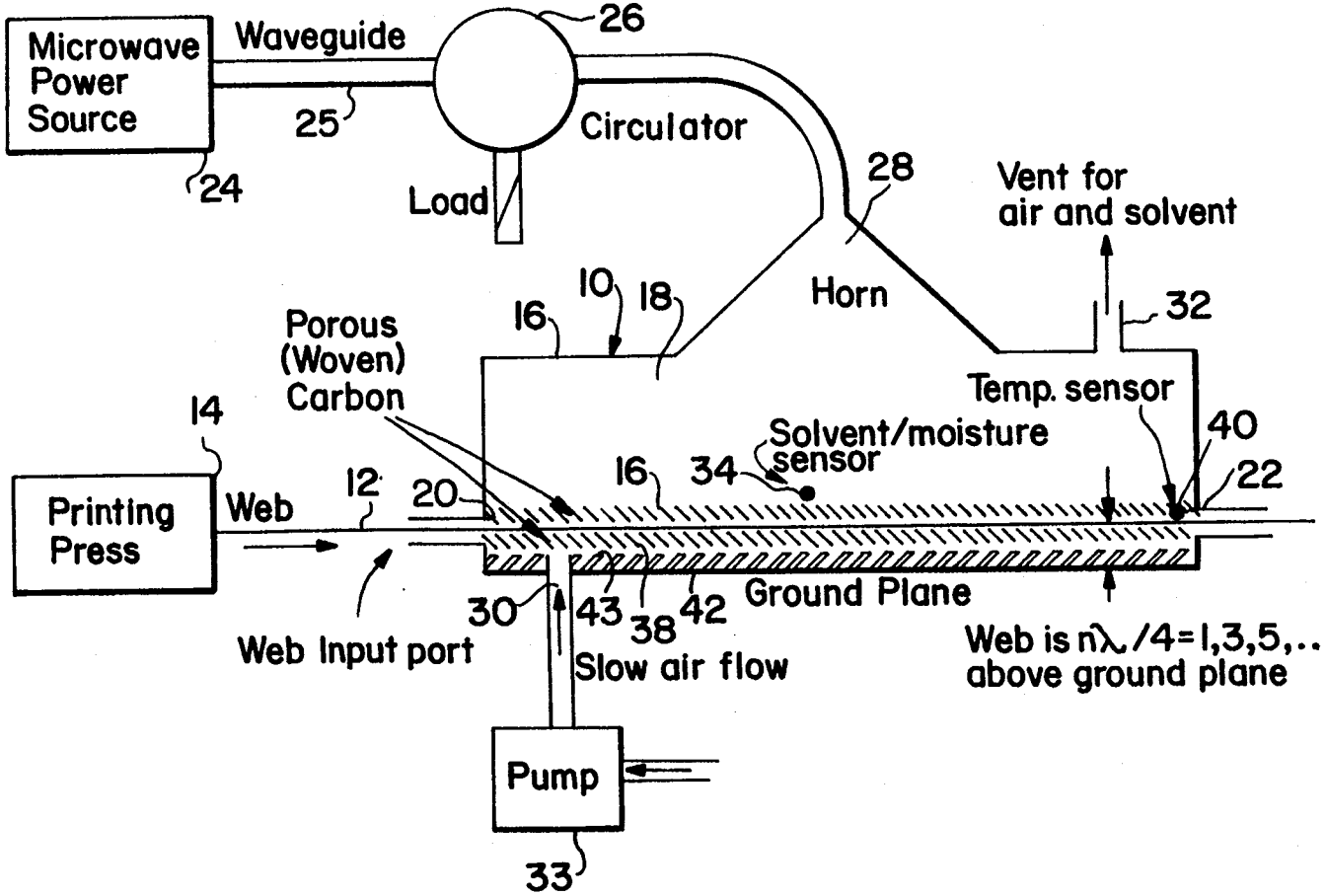
FIG. 1 is a diagrammatic view of a device for heating a printed web from a printing press of the present invention.

Referring now to FIG. 1, there is shown a microwave heating device generally designated 10 for inks on a printed web 12 passing from a printing press generally designated 14. In typical form, opposed sides of the web are printed with the inks by the press 14. The inks are typically composed of a vehicle comprising a resin and a solvent to lower the viscosity of the resin, and a colored pigment and other additives in the vehicle. When the printed inks pass from the press 14, the inks are wet, and must be heat set or dried in order to remove a substantial portion of the solvents from the ink and thus heat set and solidify the inks.

As shown, the device 10 has an elongated tunnel 16 defining a chamber 18 in order to heat the web 12. The tunnel 16 has an inlet slot 20 with dimensions slightly larger than those of the web 12 in order to permit passage of the printed web 12 from the press 14 into the chamber 18. The tunnel 16 also has an outlet slot 22 with dimensions slightly larger than those of the web 12 in order to permit passage of the heated web 12 from the chamber 18. The relatively close dimensions of the slots 20 and 22 relative to the web 12 prevent the escape of air, the solvents, and microwave energy from the chamber 18 into the atmosphere.

The device 10 has a microwave power source 24 for generating microwave energy for the chamber 18. Typical, power levels of up to 50 kW at 915 MHz and up to 10 kW at 2450 MHz from single sources are presently available. The source 24 is connected by a suitable waveguide 25 to a circulator 26 which isolates the source 24 from reflected waves in the chamber 18. The tunnel 16 has a suitable horn 28 for introducing the microwave energy from the source (typically 915 MHz or 2450 MHz) into the chamber 18 for heating the web 12.

As shown, the tunnel 16 has an inlet 30 for the passage of air into the chamber 18, and an outlet 32 for passing the air out of the chamber 18. The air passing from the chamber 18 caries solvents from the heated ink on the web 12, and the air is then cooled in order to condense water and the solvents from the air. If desired, the treated air may be recirculated into the inlet 30 of the chamber 18 through use of a suitable pump 33 connected between the inlet 30 and outlet 32.

Figure 2:
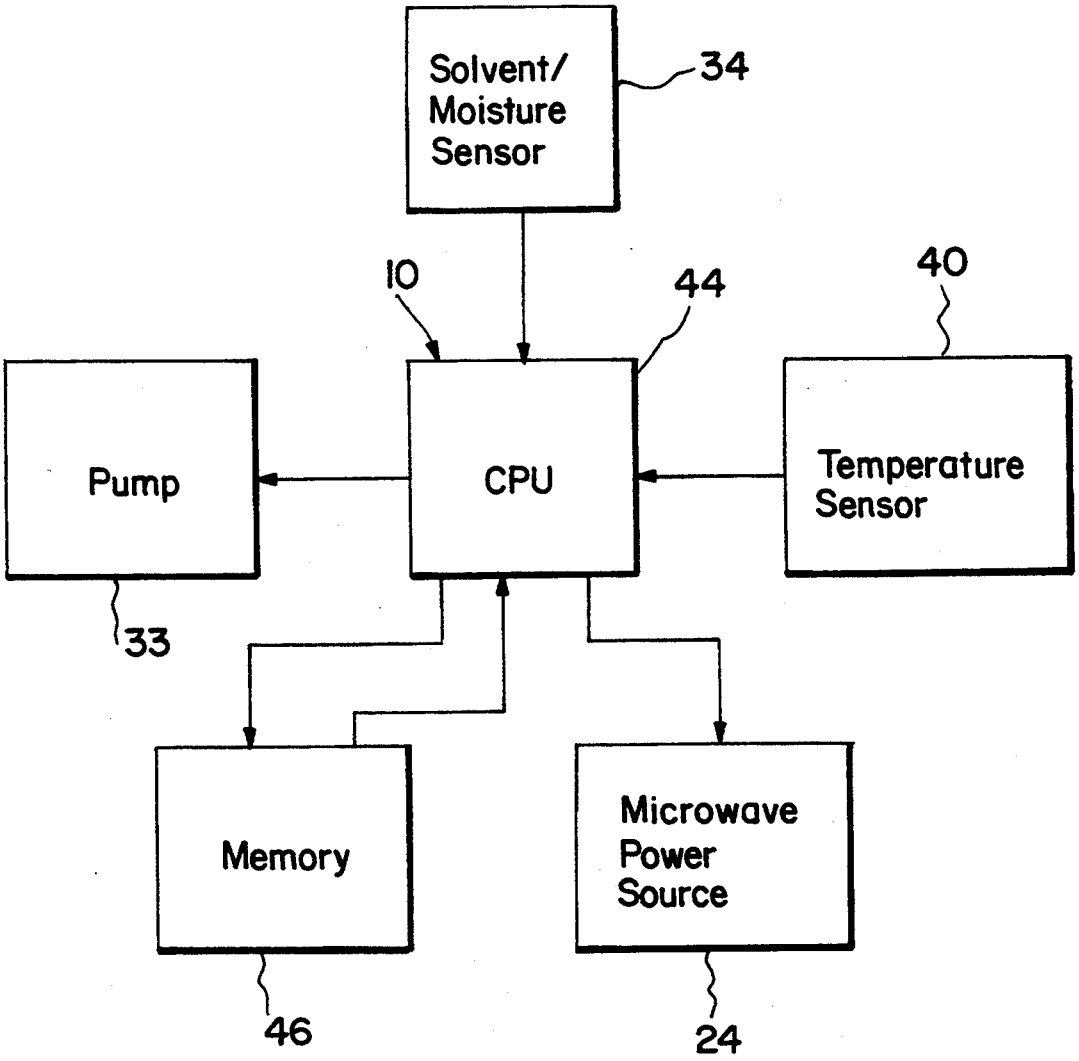
FIG. 2 is a block diagram of a control system for the heating device of FIG. 1.

The device 10 has a solvent/moisture sensor 34, such as a solvent sensor Model Nos. TGS 822, sold by Figaro of Winnetka, Ill., as know to the art, or a moisture sensor Models TF- and M-series sold by Panametrics, as known to the art, to detect solvents and moisture in the chamber 18, and, as will be seen below, the sensor 34 may be utilized to control the rate of circulation of the air into and out of the chamber 18 in an automatic manner through use of a Central Processing Unit (CPU) or computer 44 which may have a suitable memory, as shown in FIG. 2. If too much solvent is detected in the air of the chamber 18, then the rate of circulation of air is increased in the chamber 18. If too small a quantity of moisture or solvent is detected in the air, then the rate of circulation of the air is slowed in order to prevent too much drying of the web 12, and possible static electricity on the web 12 as it passes out of the chamber 18. Thus, the device 10 automatically maintains the flow of air into and out of the chamber 18 in a desired range of flow rate.

The device 10 has a pair of porous woven carbon panels 36 and 38 which substantially cover opposed surfaces of the web 12, and which are located adjacent the opposed surfaces of the web 12. The panels 36 and 38 are porous to the passage of microwaves energy in the chamber, and serve to maintain elevated temperatures near the web 12. The woven panels 36 and 38 are designed to absorb about 5 to 15% of the microwave power, and thus preheat the air utilized to evaporate the solvents. The remainder of the microwave power is applied directly to the web 12 in order to heat the web 12, and remove the solvents from the inks.

In a preferred form, the device has a wall 42 defining a reflective surface 43 to the microwaves, and the web 12 is positioned in the chamber 18 at a location approximately ¼ the wavelength of the microwaves taken from the reflective surface 43 of the wall 42, or any odd multiple of quarter wavelengths of the microwaves taken from the reflective surface 43 of the wall 42 where the electric field of the microwaves is a maximum. One-quarter wavelength is approximately 8.2 cm (3.2 inches) for 915 MHz and 3.06 cm (1.2 inches) for 2450 MHz, both frequencies being standard frequencies for commercial microwave heating. These dimensions may be modified slightly due to the porous layers placed on either side of the web. The bulk of the microwave energy enters the web since it passes through a maximum electric field region, which is to be found at an odd number of quarter wavelengths above the ground plane of the microwave oven.

Microwave power does not rely on convective heat transfer or thermal conductivity, but goes directly into heating the web. Extremely high powers can be used which causes rapid temperature rise. Energy usage by the device 10 is very efficient, and the heat requirements may be calculated as the worst possible case using the following assumptions:

| | |
|---|---|
| Solvent and Water Vaporized | 2.4 lb./million sq. in. |
| Weight of Paper | 129 lb./million sq. in. |
| Web Width | 26 in. |
| Printing Speed | 3,000 ft./min. |
| Final Temperature | 375 deg. F. (No Vaporization Until this Temperature) |
| Constant Heat Capacity | 4.186 Joules/g of Solvent and Water |
| Heat of Vaporization | 2.26 kJoules/g |
| Heat Consumption of Paper | 315 Joules/g (to Heat the Paper to 375 deg. F.) |

Based upon the parameters given above, the following values were obtained:

| | |
|---|---|
| Power to Heat Solvents | 12.1 kW |
| Power to Vaporize Solvents | 38.4 kW |
| Power to Heat Paper | 17.2 kW |
| Total Power | 67.7 kW |

Microwave sources at 915 MHz are typically 85–92% efficient, and at 2450 MHz are typically 60% efficient. Less than 10% power loss is expected for microwave power transfer. The heating tunnel 16 or chamber 18 may be very short, such as about 4 to 8 feet, thus reducing the amount of heated air needed which in turn reduces energy consumption and the need for cooling. Approximately 50–70 kW of energy is needed for heating the web and setting the inks at faster printing speeds to 3,000 ft./min. This result may be achieved utilizing single or multiple sources of the two described microwave frequencies, rather than the large MW energy which would be required for convection heat transfer.

The requirements for a heating system in a commercial press for drying may be computed based upon input fluid loading of about 2.4 lb/million sq. in. of web area. Depending upon the mix of solvent and water, the maximum energy is estimated to be about 50–70 kW for web velocities up to 3,000 ft./min. and a web width of 26 inches. Gas-fired heating chambers require energy input up to 8 MW to provide similar performance to a microwave heater, since conventional heating systems which rely on convective heat transfer are inefficient when compared to the microwave heating device 10 of the present invention which supplies energy directly to the web.

With reference to FIGS. 1 and 2, the device 10 has a temperature sensor 40 positioned in the chamber 18 in order to determine the operating temperature of the air which removes the solvents. As will be further seen below, the device 10 may use the CPU in order to control the microwave energy source 24 responsive to the sensor 40 to maintain a desired range of temperatures in the chamber 18. For example, if the temperature of the air in the chamber 18 is too high as measured by the sensor 40, the web 12 may become blistered, while if the temperature of the air is too low as measured by the sensor 40, then sufficient solvent may not be removed quickly from the web 12, and, thus, the temperature of the air is automatically maintained in a desired range of temperatures.

As shown in FIG. 2, The device 10 has the CPU or computer 44 having a suitable memory 46. The solvent- /moisture sensor 34 is connected to the CPU, and in response the CPU controls the pump 33 in order to control the rate of passage of air through the chamber 18 in a desired range. The temperature sensor 40 is also connected to the CPU, and the CPU controls the microwave energy supplied by the power source 24 within a desired range in order to maintain the desired range of temperatures in the chamber 18.

Thus, in accordance with the present invention, the microwave device 10 supplies microwave energy to the chamber 18 in order to heat set or dry inks on the web 12 in a more rapid and efficient manner. The tunnel 16 may be made shorter since less time is requited to heat set the inks on the web 12, and the speed of the press 14 and moving web 12 may be increased since the inks on the web are dried faster. Further, less energy is required to heat set the ink on the web 12, and the shorter tunnels are less costly to manufacture in order to reduce the cost of making and operating the press 14.

The foregoing detailed description has been given for clearness of understanding only, and no unnecessary limitations should be understood therefrom, as modifications will be obvious to those skilled to the art.

What is claimed is:

1. A device for heating a printed web associated with a printing press, comprising:

means defining a chamber having an inlet for introducing the web into the chamber, and an outlet for removing the web from the chamber; and means for introducing a source of microwaves into the chamber to heat the web and heat set an ink on the web, including a layer of microwave energy absorbing means covering opposed sides of the web.

2. The device of claim 1 wherein the inlet has dimensions slightly larger than the web.

3. The device of claim 1 wherein the outlet has dimensions slightly larger than the web.

4. The device of claim 1 wherein the introducing means includes a source of microwaves external from the chamber.

5. The device of claim 4 wherein the introducing means includes means for isolating the source of microwaves from reflected microwaves in the chamber.

6. The device of claim 5 including a wave guide from the source of microwaves.

7. The device of claim 1 including means for passing a gas in said chamber to carry solvents from the heated ink.

8. The device of claim 7 wherein the passing means comprises means for circulating air in said chamber.

9. The device of claim 1 wherein the absorbing means comprises a pair of porous panels.

10. The device of claim 9 wherein said porous panels comprise a pair of carbon woven panels located adjacent opposed sides of the web.

11. The device of claim 10 including means defining a reflective surface to microwaves in the chamber, and in which the web is located approximately ¼ wavelength of the microwaves spaced from the reflective surface or an odd multiple of quarter wavelengths of the microwaves spaced from the reflective surface.

12. The device of claim 1 including means defining a reflective surface to microwaves in the chamber, and in which the web is located approximately ¼ wavelength of the microwaves spaced from the reflective surface in the chamber.

13. The device of claim 1 including means for preventing leakage of the microwaves from the chamber.

14. A device for heating associated with a printing press, comprising:

a web having a printed ink on at least one surface of the web;

means defining a chamber;

means for passing the web through the chamber;

a source of microwave energy;

means for passing the source into the chamber to heat the ink on the web;

means for passing air through the chamber to remove solvent from the chamber;

means for absorbing a portion of the microwave energy adjacent opposed surface of the web; and means for defining a reflective surface to the microwave energy in the chamber, with the reflective surface being located approximately ¼wavelength of the microwaves from the web or any odd multiple of quarter wavelengths of the microwaves from the web.

15. The device of claim 14 including means for separating the source from reflected microwaves in the chamber.

* * * * *